US006114806A

United States Patent [19]

Itoh

[11] Patent Number: 6,114,806

[45] Date of Patent: Sep. 5, 2000

[54] HERMETIC CONTAINER

[75] Inventor: Shigeo Itoh, Mobara, Japan

[73] Assignee: Futaba Deshi Kogyo K.K., Mobara, Japan

[21] Appl. No.: 09/027,229

[22] Filed: Feb. 20, 1998

[30] Foreign Application Priority Data

Feb. 21, 1997 [JP] Japan ..... 9-037782

[51] Int. Cl.[7] ..... H01J 17/24

[52] U.S. Cl. ..... 313/553; 313/552; 313/495; 313/560

[58] Field of Search ..... 313/552, 553, 313/556, 563, 564, 495, 560

[56] References Cited

U.S. PATENT DOCUMENTS

| | | | |
|---|---|---|---|
| 5,453,659 | 9/1995 | Wallace et al. | 313/553 X |
| 5,525,861 | 6/1996 | Banno et al. | 313/553 X |
| 5,656,889 | 8/1997 | Niiyama et al. | 313/553 |
| 5,789,859 | 8/1999 | Watkins et al. | 313/554 X |

*Primary Examiner*—Ashok Patel
*Attorney, Agent, or Firm*—Oblon, Spivak, McClelland, Maier & Neustadt, P.C.

[57] ABSTRACT

A hermetic container which does not require a getter room and can reliably absorb gases released in a container. In a field emission display, the hermetic container contains a front substrate and an opposite substrate confronting each other and a spacer disposed between the outer fringes of the front substrate and the outer fringes of the opposite substrate. Stripe anodes are formed on the inner surface of the front substrate. Each anode is formed of a transparent anode conductor and a fluorescent substance layer. Field emission elements are formed on the inner surface of the opposite substrate and respectively have a cathode conductor, an insulating layer, a gate, and an emitter disposed in an opening. Each of supports has one end which is disposed between stripe anodes and is in contact with the front substrate and the other end which is disposed between stripe gates and is in contact with the insulating layer. Each support has a core formed of a carbon fiber or glass fiber with large tensile resistance and good absorptivity. A non-evaporation getter is vapor-deposited on the surface of the core. The container shows a high resistance to crushing. A number of supports are posted near to anodes and field emission elements and can certainly absorb gases released in the container, near to the gas generating source. The supports can eliminate the getter room.

2 Claims, 2 Drawing Sheets

HERMETIC CONTAINER

BACKGROUND OF THE INVENTION

1. Field of the Invention

This invention relates to a hermetic container which is useful as a container for display elements including field emission elements, for fluorescent display tubes, or for equivalents.

2. Description of the Related Art

FIG. 2 is a cross sectional view illustrating a field emission display (FED) using field emission elements. A front substrate 101 confronts an opposite substrate 102 so as to be spaced a predetermined distance apart. The gap between the outer fringes of the substrate 100 and the outer fringes of the substrate 101 is sealed with a spacer 102 to construct a container 103. Transparent anode conductors and anodes 104 with fluorescent substance layers are formed on the inner surface of the front substrate 100. Field emission elements 105, or cold cathodes, acting as electron sources are formed on the inner surface of the opposite substrate 101. The field emission elements 105, not shown in detail in FIG. 2, includes cathode conductors formed on the inner surface of the opposite substrate 101, an insulating layer formed over the cathode conductors, gates formed on the insulating layer, and cone emitters each formed on each cathode conductor and in an opening formed in the insulating layer and the gates. When a predetermined anode voltage is applied to the anode 104 and a predetermined voltage is applied to the cathode conductor and the gate in the field emission element 105, electrons are emitted from the tip of the cone emitter to the anode 104, thus glowing the fluorescent substance layer. The glowing of the fluorescent substance layer is viewed through the transparent anode conductor from the outside of the front substrate 100.

In the container 103, supports are often posted between the front substrates 100 and the opposite substrate 101 to maintain the gap between the substrates 100 and 101 to a predetermined small value against the atmospheric pressure.

The container, as shown in FIG. 2, has a getter room 110 that houses a getter for absorbing gases remaining inside the container. The getter room 110 is communicated with the container 103. A getter 111 which is formed of a getter substance filled in a ring cavity is disposed in the getter room 110. An exhaust tube 112 is mounted to the getter room 110 to evacuate air from the container 103. By induction heating the cavity of the getter 111, the getter substance is evaporated to form a getter film over the inner surface of getter room 110.

Generally, in order to fabricate an FED as a flat display element, the gap between the substrates forming the container is often set to a smaller value than the thickness of each substrate. However, the problem is that the whole display element cannot be thinned, in spite of the use of the thin container, because the getter room has a predetermined size to house a getter support. For example, the thickness of the container itself is 2.5 mm or less, but the getter room plus and the exhaust tube protrude 3 to 4 mm ahead.

Since the getter room communicates with the inside of the container at the end portion thereof, the getter can easily absorb gases released from anodes near to the communicating portion. However, it is difficult to effectively absorb gases released from anodes distant from the communicating portion.

SUMMARY OF THE INVENTION

The present invention is made to overcome the above-mentioned problems. The object of the invention is to provide a hermetic container that does not require any getter room and can certainly absorb gases remaining therein.

According to the present invention, a hermetic container which contains a first substrate, a second substrate disposed so as to confront said first substrate, a spacer member for sealing a gap between the outer fringes of the first substrate and the outer fringes of the second substrate, anodes each formed on the first or second substrate, each of the anodes on which a fluorescent substance is coated, and cathodes each which emits electrons onto an anode, the hermetic container comprising supports posted between the first substrate and the second substrate, each of the supports having at least a portion acting as a getter.

According to the present invention, the hermetic container further comprises a non-evaporation-type getter layer formed on at least a surface of each of the supports.

In the hermetic container according to the present invention, each of the supports comprises a core formed of a carbon fiber or glass fiber and a non-evaporation-type getter layer formed on at least a surface of the core.

Moreover, according to the present invention, the nonevaporation-type getter layer comprises at least one selected from the group consisting of Zr, V, Ti, and Fe. According to the present invention, each of the supports comprises a getter material.

According to the present invention, the getter material contains at least one selected from the group consisting of C, Zr, V, Ti, and Fe.

Furthermore, according to the present invention, each of the cathodes comprises a field emission element formed on the first or second substrate.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
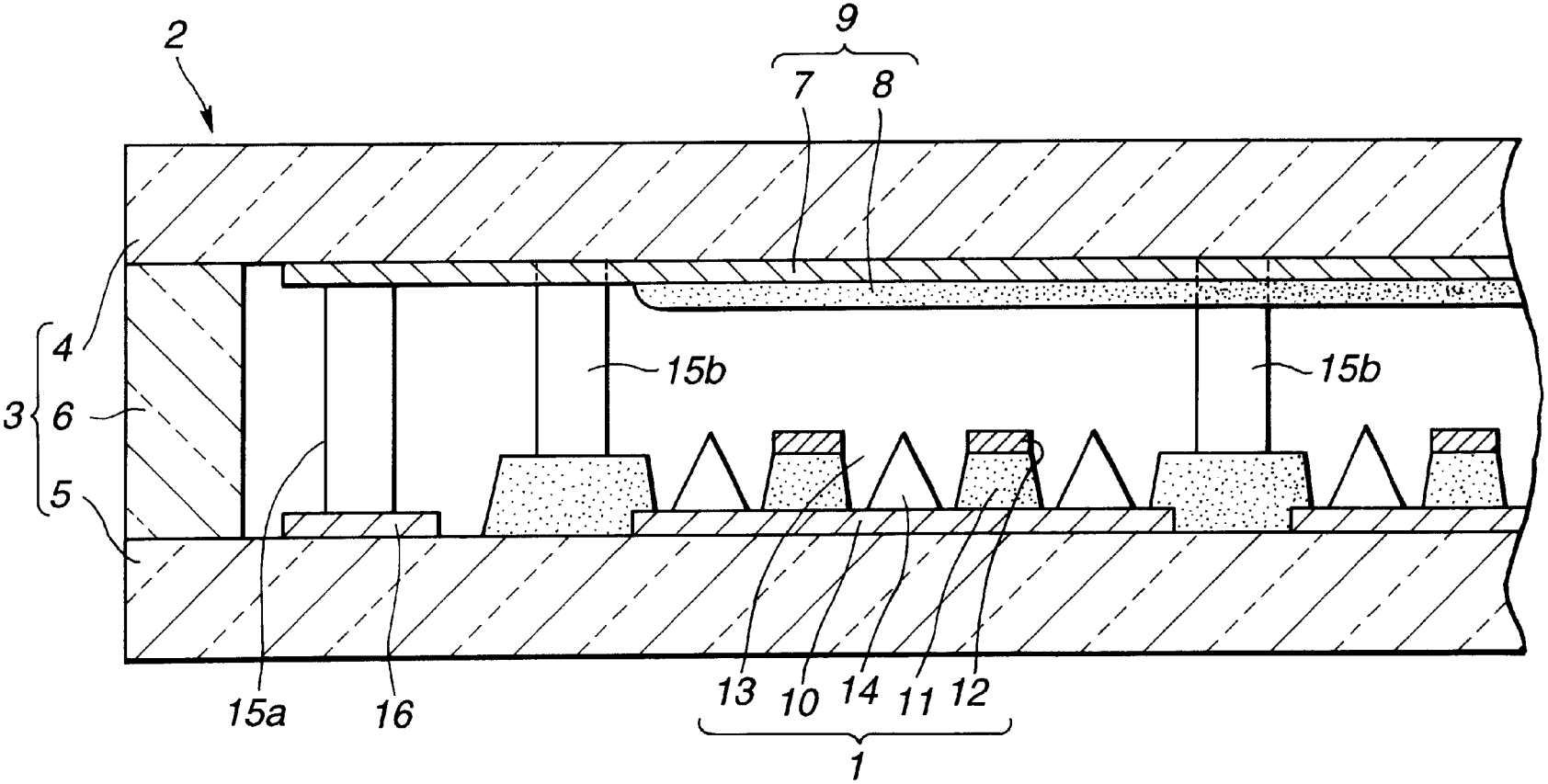
FIG. 1 is a cross-sectional view illustrating a hermetic container according to an embodiment of the present invention.
Figure 2:
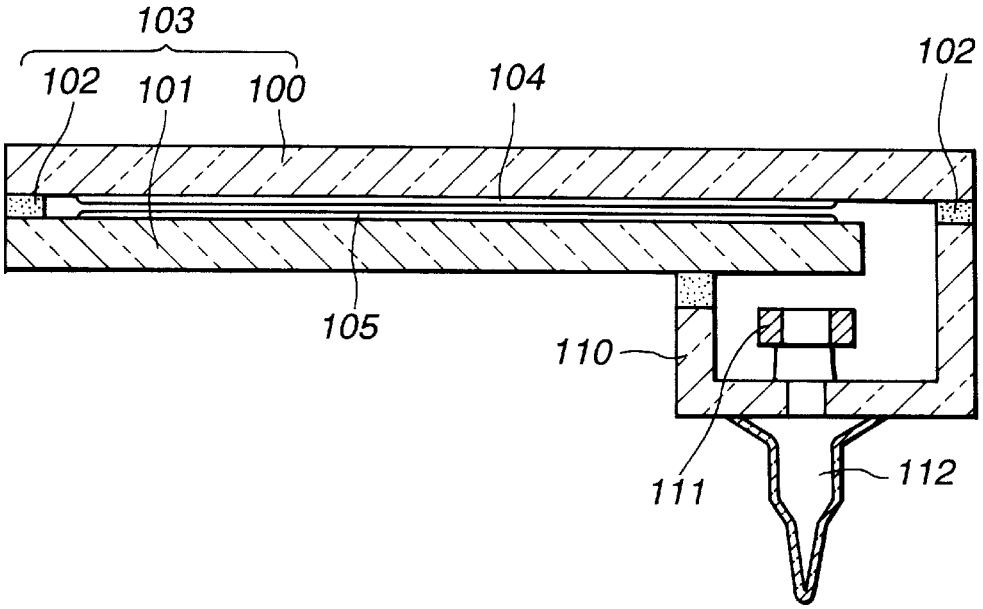
FIG.2 (PRIOR ART)
FIG. 2 is a cross-sectional view illustrating a conventional field emission display.

The embodiment according to the present invention will now be described below in detail with reference to FIG. 1

In the container 3 being a hermetic container for a field emission display (FED) 2 using field emission elements 1, the front substrate 4 confronts the opposite substrate 5 so as to be spaced a predetermined distance apart. The gap between the outer fringes of the front substrate 4 and the outer fringes of the opposite substrate 5 is sealed with a spacer 6. Transparent anode conductors 7 are arranged on the inner surface of the front substrate 4. A fluorescent substance layer is coated on each anode conductor 7 to complete the anode 9.

In this embodiment, a plurality of anodes 9 in a stripe pattern (horizontally and longitudinally in FIG. 1) are arranged at predetermined intervals (in vertical orientations on paper). A number of color fluorescent substance groups are coated on each anode 9 in a predetermined order and alternately. Each group includes three colors: red (R), green (G) and, blue (B).

Field emission elements 1 or cold cathodes, acting as electron sources are formed on the inner surface of the opposite substrate 5. The field emission element 1 includes a cathode conductor 10 formed on the inner surface of the opposite substrate 5, an insulating layer 11 formed on the cathode conductor 10, a gate 12 formed on the insulating layer 11, cone emitters 14 formed on the cathode conductor 10 and respectively in the opening 13 formed in the insulating layer 11 and the gate 12. In some cases, a resistance layer or current control element may be disposed between the cathode conductor 10 and the emitter 14.

In the field emission element 1, a plurality of gates 12 in a stripe pattern (longitudinally and horizontally extending in FIG. 1) are arranged at predetermined intervals (in vertical orientation on paper). A plurality of cathode conductors 10 in a stripe pattern (vertically and longitudinally extending on paper) are arranged at predetermined intervals. By driving a matrix of the cathode conductors 10 and the gates 12, an emitter 14 at a predetermined location can be selected to emit electrons.

When the field emission element 1 is driven in synchronization with the scanning of the anode 9, electrons are emitted from the tip of the cone emitter 14 to the anode 9 to glow the fluorescent substance layer 8, so that a desired full color graphic display can be performed. The display can be observed from the outside of the front substrate 4 through the transparent anode conductor 7.

In the field emission display 2, supports 15*b* are posted between the front substrate 4 and the opposite substrate 5 to withstand the atmospheric pressure exerted on the container 3. Each of the supports 15*b* has one end being between the stripe anodes 9 and in contact with the front substrate 4 and the other end being between stripe gates 12 and in contact with the insulating layer 11. Hence, the support 5 does not electrically conduct the anode 9 with the gate 12 in the field emission element As shown in FIG. 1, supports 15*a* are disposed on the internal fringes of the container 3 and between the anode conductor 7 of the front substrate 4 and the lead-out conductor 16 of the opposite substrate 5 to conduct the anode conductor 7 with the lead-out conductor 16. In this structure, the anode conductors are derived from the opposite substrate 5 outward the container 3, together with electrodes of the field emission elements 1.

The support 15 (15*a*, 15*b*) is formed of a core formed of a carbon fiber or glass fiber and a non-evaporation-type getter deposited on the surface of the core. Zr, V, Ti, Fe, or the like can be utilized as a non-evaporation-type getter.

The carbon fiber with large tensile resistance and excellent isotropic mechanical strength is suitable for a reinforcing member for supporting the hermetic container under the atmospheric pressure. The carbon fiber has a high elasticity modulus of 350 to 700 kg/mm$^2$. A suitably-tailored carbon fiber can be sandwiched and surely fixed between the substrates. The carbon fiber in black and with a low light reflection property does not adversely affect the display quality of the FED.

The carbon fiber is made by forming microcrystalline fibers of carbon atoms in orientation and cohering them under pressure. This carbon fiber shows a high conductivity in the radial direction and an extremely high conductivity in longitudinal direction as high as that of graphite. The difference between the conductivity in the longitudinal direction and the conductivity in the radial direction is about $10^5$. For that reason, the support 15 can act as a conductive member that leads the anode conductor 7 on the front substrate 4 toward the opposite substrate 5.

The carbon fiber has a large specific surface area of, for example, 500 to 2500 m$^2$/g and has a huge number of pores of a diameter of 10 to 20 Å, thus providing an extreme excellent absorptivity, compared with activated charcoal. In this embodiment, a getter substance is vapor-deposited on the core of the carbon fiber. A number of cores are respectively posted near to the anodes 9 or the field emission elements 1 acting as gas releasing sources. Hence, the present structure can more effectively absorb various kinds of gas released inside the container 3, compared with the conventional structure where an evaporation-type getter is housed in the getter room apart from the gas generating sources and differently separated from the container. The present embodiment does not require adding the getter room to the container 3. The supports 15 posted close to the gas generating places can certainly adsorb harmful or unwanted gases released in the container 3, thus preventing a decrease in the vacuum degree. As described earlier, since the getter room thicker than the container 3 is not needed, the container of a field emission display is characterized by its thinness.

In the present embodiment, a non-evaporation-type getter is vapor-deposited on the surface of the core containing carbon fiber. However, the fairly good effect can be achieved by vapor-depositing the non-evaporation-type getter on the surface of the core of containing a carbon fiber or on the surface of the support formed of a ceramic or glass-fritted material. Moreover, the same effect can be obtained by forming (at least part of) the support itself with a material having a getter function.

According to the present embodiment, the gate 12 in the field emission element 1 and the anode 9 are formed in a predetermined stripe pattern. The supports 15 including a conductive carbon fiber are posted between the stripe patterns. However, where each electrode has a pattern other than a stripe pattern, a non-conductive region for posting a support is formed at the position where the anode on the front substrate 4 confronts the field emission element on the opposite substrate 5. Thus, the support can be posted so as not to conduct the anode with the gate of the field emission element. The support may be posted between substrates so as to have one end butting at one substrate via an insulating layer and the other end butting at the other substrate via an insulating layer. In the case of the use of a non-conductive support, the support can be posted between substrates so as to directly butt against the electrode on one substrate and the electrode on the other substrate.

The present embodiment uses stripe electrodes each on which fluorescent substance layers glow red, green, and blue respectively. However, the anode may be formed of a solid plate having a monochrome fluorescent substance layer. In this case, the support having a getter function is formed of a non-conductive support or is disposed between substrates via insulating materials, According to the present invention, the supports with getter functions are posted within the container including anodes and cathodes each which may release gasses. Hence, Each of the supports improves the compression-resistance performance of the container and effectively absorbs gases released therein to certainly maintain the vacuum degree in the container. This structure can eliminate the thick getter room attached to the conventional container. Moreover, this structure is applicable to a thin field emission display which is characterized by its thinness.

Particularly, the support formed of a carbon fiber on which a non-evaporation-type getter is vapor-deposited can provide a sufficient mechanical strength to improve the compression-resistance performance of the container. Moreover, the support can more effectively absorb gases released in the container. The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A hermetic container comprising:

a first substrate;

a second substrate, said first and second substrates being spaced from one another by a relatively small distance;

a spacer for sealing the outer fringes of said first and second substrates to provide a cavity between said first and second substrates;

a plurality of anodes formed on said first substrate, said anodes having fluorescent material deposited thereon;

a plurality of cathodes formed on said second substrate for emitting electrons to impinge said fluorescent material to excite said fluorescent material and result in luminescence; and a plurality of supports made of a getter material, said supports being arranged in said cavity vertically extending between said first and second substrates to maintain said substrates a predetermined distance apart and bear against external pressure exerted on said substrates.

2. The hermetic container as defined in claim 1, wherein said getter material comprises one of C, Zr, V, Ti, and Fe.

* * * * *

UNITED STATES PATENT AND TRADEMARK OFFICE

CERTIFICATE OF CORRECTION

PATENT NO. : 6,114,806
DATED : September 5, 2000
INVENTOR(S) : Shigeo ITOH

It is certified that error appears in the above-identified patent and that said Letters Patent is hereby corrected as shown below:

On the title page, the Assignee information is listed incorrectly. Item [73] should read as follows:

—[73] Assignee: Futaba Denshi Kogyo K.K., Mobara, Japan—

Signed and Sealed this

Fifth Day of June, 2001

*Attest:*

*Attesting Officer*

Nicholas P. Godici

NICHOLAS P. GODICI

*Acting Director of the United States Patent and Trademark Office*